US010115513B2

(12) United States Patent
Yen et al.

(10) Patent No.: US 10,115,513 B2
(45) Date of Patent: Oct. 30, 2018

(54) INTEGRATED INDUCTOR STRUCTURE

(71) Applicant: Realtek Semiconductor Corporation, Hsinchu (TW)

(72) Inventors: Hsiao-Tsung Yen, Hsinchu (TW); Yuh-Sheng Jean, Hsinchu County (TW); Ta-Hsun Yeh, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 301 days.

(21) Appl. No.: 14/716,899

(22) Filed: May 20, 2015

(65) Prior Publication Data

US 2016/0225508 A1 Aug. 4, 2016

(30) Foreign Application Priority Data

Feb. 2, 2015 (TW) ..... 104103430 A

(51) Int. Cl.

| | |
|---|---|
| ***H01F 27/32*** | (2006.01) |
| ***H01F 38/12*** | (2006.01) |
| ***H01F 27/28*** | (2006.01) |
| ***H01F 5/00*** | (2006.01) |
| ***H01F 17/00*** | (2006.01) |

(52) U.S. Cl.

CPC ... *H01F 17/0006* (2013.01); *H01F 2017/008* (2013.01)

(58) Field of Classification Search

USPC ..... 336/84 C, 84 M, 226, 200, 232

See application file for complete search history.

(56) References Cited

U.S. PATENT DOCUMENTS

| | | | | |
|---|---|---|---|---|
| 6,310,387 | B1 | 10/2001 | Seefeldt et al. | |
| 6,980,075 | B2 * | 12/2005 | Mheen | H01F 17/0006 257/531 |
| 7,164,339 | B2 * | 1/2007 | Huang | H01F 17/0006 336/200 |
| 8,400,232 | B2 * | 3/2013 | Leong | H01P 5/10 333/25 |
| 2003/0001709 | A1 * | 1/2003 | Visser | H01F 17/0006 336/200 |
| 2003/0222750 | A1 * | 12/2003 | Kyriazidou | H01F 17/0013 336/200 |
| 2011/0006872 | A1 * | 1/2011 | Nazarian | H01F 17/0006 336/84 C |
| 2011/0043316 | A1 * | 2/2011 | Yang | H01F 19/04 336/192 |

(Continued)

*Primary Examiner* — Elvin G Enad
*Assistant Examiner* — Kazi Hossain
(74) *Attorney, Agent, or Firm* — CKC & Partners Co., Ltd.

(57) ABSTRACT

An integrated inductor structure includes a guard ring, a patterned ground shield, and an inductor. The guard ring includes an inner ring, an outer ring, and an interlaced structure. The inner ring is disposed in a first metal layer, and includes at least two inner ring openings. The outer ring is disposed in a second metal layer, and includes at least one outer ring opening. The interlaced structure is coupled to one of the at least two inner ring openings and the outer ring opening in an interlaced manner, such that the outer ring opening is enclosed. The patterned ground shield is disposed at an inner side of the inner ring, and coupled to the inner ring and the outer ring. The inductor is formed above the guard ring and the patterned ground shield.

8 Claims, 13 Drawing Sheets

(56) References Cited

U.S. PATENT DOCUMENTS

| | | | | |
|---|---|---|---|---|
| 2012/0242406 | A1* | 9/2012 | Ke | H01F 27/2804 330/195 |
| 2013/0257577 | A1* | 10/2013 | Nazarian | H01F 5/003 336/200 |
| 2014/0077919 | A1* | 3/2014 | Godoy | H01F 27/006 336/220 |
| 2015/0084733 | A1* | 3/2015 | Sun | H01F 27/362 336/84 C |

* cited by examiner

INTEGRATED INDUCTOR STRUCTURE

RELATED APPLICATIONS

This application claims priority to Taiwan Application Serial Number 104103430, filed Feb. 2, 2015, which is herein incorporated by reference.

BACKGROUND

Field of Invention

The present invention relates to a semiconductor structure. More particularly, the present invention relates to an integrated inductor structure.

Description of Related Art

With advances in technology, manufacturing processes of integrated inductors are developing toward 28 nm and 20 nm. Such extremely small dimensions of integrated inductors, however, are the cause of a number of negative effects. For example, the capacitance thereof is high since the oxide layer of the integrated inductor is thin, the capacitance among redistribution layers (RDL) is high since the RDLs employed in the integrated inductor is thick, and so on. Such situations will affect the quality factor of inductors.

In view of the foregoing, problems and disadvantages are associated with existing products that require further improvement. However, those skilled in the art have yet to find a solution.

SUMMARY

The following presents a simplified summary of the disclosure in order to provide a basic understanding to the reader. This summary is not an extensive overview of the disclosure and it does not identify key/critical elements of the present invention or delineate the scope of the present invention.

One aspect of the present disclosure is directed to an integrated inductor structure. The integrated inductor structure includes a guard ring, a patterned ground shield, and an inductor. The guard ring includes an inner ring, an outer ring, and an interlaced structure. The inner ring is disposed in a first metal layer, and includes at least two inner ring openings. The outer ring is disposed in a second metal layer, and includes at least one outer ring opening. The interlaced structure is coupled to one of the at least two inner ring openings and the outer ring opening in an interlaced manner, such that the outer ring opening is enclosed. The patterned ground shield is disposed at an inner side of the inner ring, and coupled to the inner ring and the outer ring. The inductor is formed above the guard ring and the patterned ground shield.

Another aspect of the present disclosure is directed to an integrated inductor structure. The integrated inductor structure includes a first guard ring, a second guard ring, an interlaced structure, a patterned ground shield, and an inductor. The first guard ring includes a first inner ring and a first outer ring. The first inner ring is disposed in a first metal layer and includes at least one first inner ring opening. The first outer ring is disposed in a second metal layer and includes at least one first outer ring opening. The second guard ring includes a second inner ring and a second outer ring. The second inner ring is disposed in the first metal layer and includes at least one second inner ring opening. The second outer ring is disposed in the second metal layer and includes at least one second outer ring opening. The interlaced structure is coupled to the at least one first inner ring opening and the at least one second outer ring opening in an interlaced manner, and coupled to the at least one first outer ring opening and the at least one second inner ring opening in an interlaced manner. The patterned ground shield is disposed at inner sides of the first inner ring and the second inner ring, and coupled to the first inner ring, the first outer ring, the second inner ring, and the second outer ring. The inductor is formed above the guard ring and the patterned ground shield.

In view of the foregoing, embodiments of the present disclosure provide an integrated inductor structure to improve the problem of a decreasing quality factor of inductors.

These and other features, aspects, and advantages of the present invention, as well as the technical means and embodiments employed by the present invention, will become better understood with reference to the following description in connection with the accompanying drawings and appended claims.

BRIEF DESCRIPTION OF THE DRAWINGS

The invention can be more fully understood by reading the following detailed description of the embodiments, with reference made to the accompanying drawings as follows.

Figure 1A:
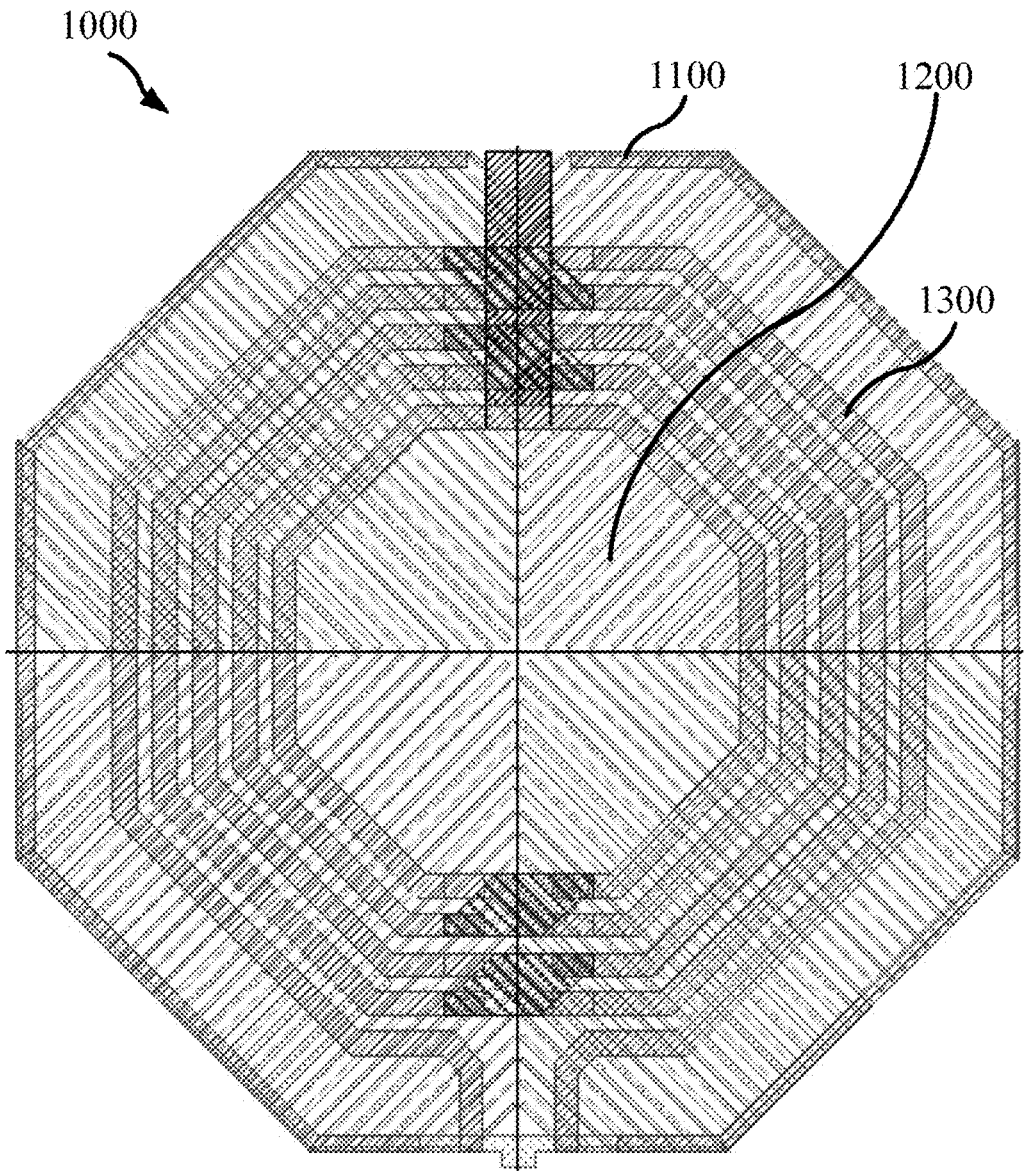
FIG. 1A is a schematic diagram of an integrated inductor structure according to embodiments of the present invention.

In accordance with common practice, the various described features/elements are not drawn to scale but instead are drawn to best illustrate specific features/elements relevant to the present invention. Also, wherever possible, like or the same reference numerals are used in the drawings and the description to refer to the same or like parts.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

Unless otherwise defined herein, scientific and technical terminologies employed in the present disclosure shall have the meanings that are commonly understood and used by one of ordinary skill in the art. Unless otherwise required by context, it will be understood that singular terms shall include plural forms of the same and plural terms shall include singular forms of the same.

For improving the quality factor of inductors, embodiments of the present invention provide an integrated inductor structure. The integrated inductor structure is illustrated in FIG. 1A. As shown in FIG. 1A, the integrated inductor structure 1000 comprises a guard ring 1100, a patterned ground shield 1200, and an inductor 1300. The way in which the present invention improves the quality factor of inductors involves improving the structure of the guard ring 1100, which will be described in detail below.

Figure 1B:
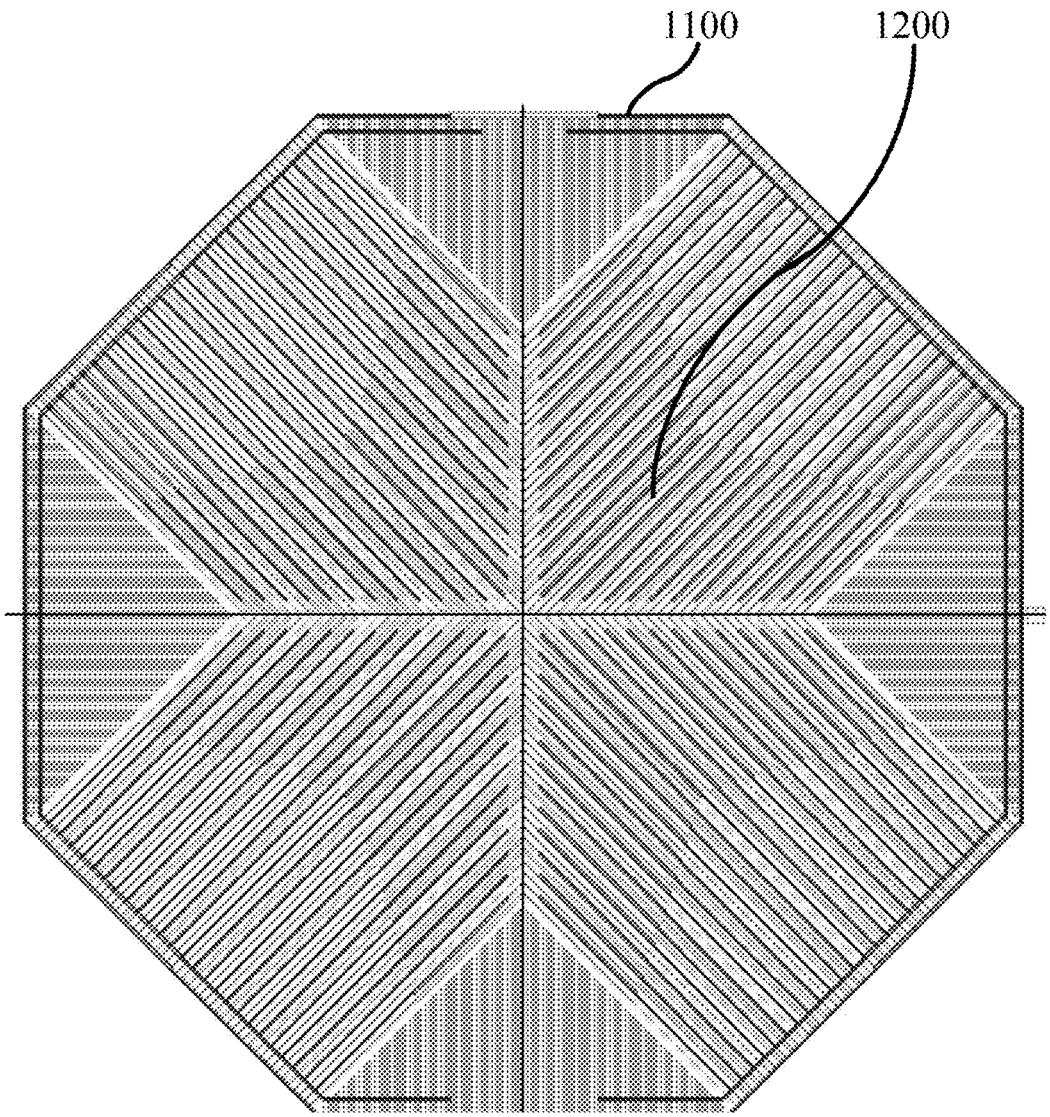
FIG. 1B is a partial schematic diagram of the integrated inductor structure of FIG. 1A according to embodiments of the present invention.
Figure 1C:
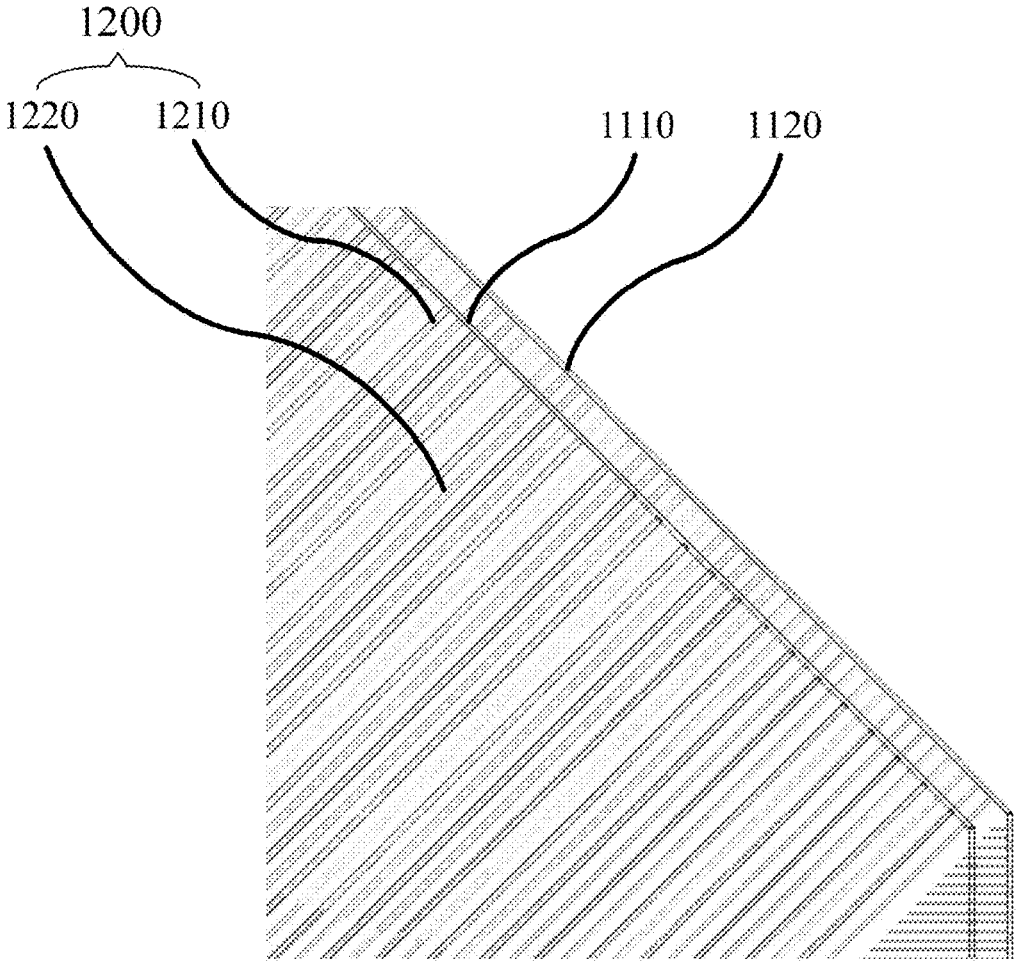
FIG. 1C is a partial schematic diagram of the integrated inductor structure of FIG. 1A according to embodiments of the present invention.

FIG. 1B and FIG. 1C are partial schematic diagrams of the integrated inductor structure of FIG. 1A according to embodiments of the present invention. FIG. 1B further illustrates the structures of the guard ring 1100 and the patterned ground shield 1200, and a detailed disposition relation of the guard ring 1100 and the patterned ground shield 1200 is illustrated in FIG. 1C. As shown in FIG. 1C, the guard ring 1100 comprises an inner ring 1110 and an outer ring 1120. The inner ring 1110 is disposed in a first metal layer of the integrated inductor structure 1000, and the outer ring 1120 is disposed in a second metal layer of the integrated inductor structure 1000. In addition, the patterned ground shield 1200 is coupled to the inner ring 1110 and the outer ring 1120. In another embodiment, the patterned ground shield 1200 comprises a first layer structure 1210 and a second layer structure 1220. The first layer structure 1210 is disposed in the first metal layer of the integrated inductor structure 1000, and coupled to the inner ring 1110. The second layer structure 1220 is disposed in the second metal layer of the integrated inductor structure 1000, and coupled to the outer ring 1120.

Figure 2:
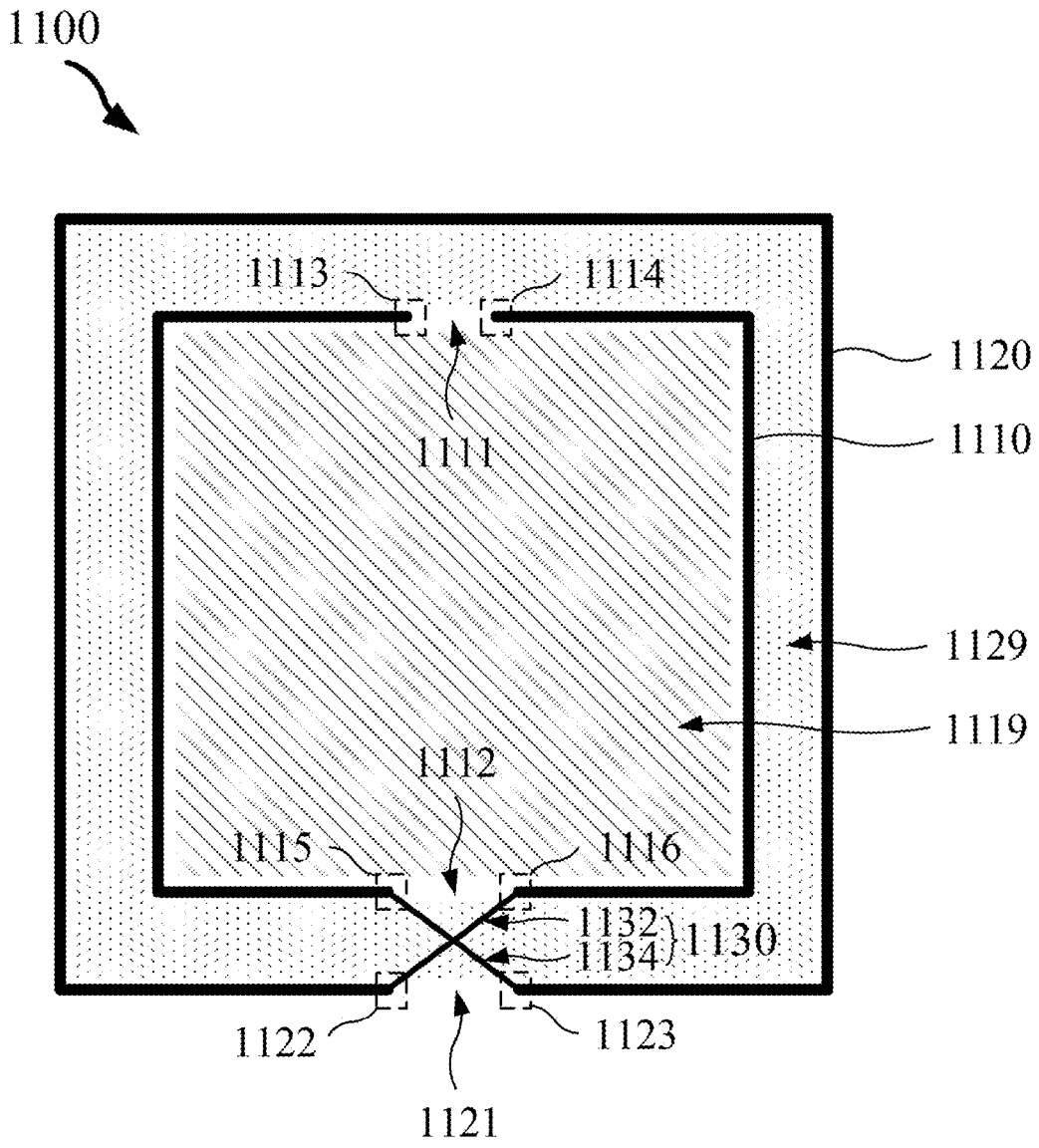
FIG. 2 is a schematic diagram of a guard ring of the integrated inductor structure of FIG. 1A according to embodiments of the present invention.

FIG. 2 is a schematic diagram of the guard ring of the integrated inductor structure of FIG. 1A according to embodiments of the present invention. As shown in FIG. 2, in addition to the inner ring 1110 and the outer ring 1120, the guard ring 1100 further comprises an interlaced structure 1130. The inner ring 1110 comprises at least two inner ring openings 1111, 1112, the outer ring 1120 comprises at least one outer ring opening 1121, and the interlaced structure 1130 is coupled to one of the at least two inner ring openings (for example, the inner ring opening 1112) and the outer ring opening 1121 in an interlaced manner, such that the outer ring opening 1121 is enclosed.

Through the improvement of the guard ring 1100 and the patterned ground shield 1200 employed in the integrated inductor structure 1000 as described above, the quality factor of the inductor 1300 in the integrated inductor structure 1000 can be improved. In addition, a typical advanced manufacturing process for manufacturing an integrated inductor will use water ($H_2O$). Therefore, steam will be generated around the inductor of the integrated inductor and this steam stores inside the integrated inductor, which will affect other structures inside the integrated inductor, and reduce the reliability of the integrated inductor. The improvement in the configuration of the guard ring 1100 employed in the integrated inductor structure 1000 of embodiments of the present invention can block the steam, such that the steam will not affect other structures inside the guard ring 1100.

Referring to FIG. 2, the structure of the guard ring 1100 will be described in detail herein. The inner ring opening 1111 comprises at least two inner ring opening terminals 1113, 1114, the inner ring opening 1112 comprises at least two inner ring opening terminals 1115, 1116, and the outer ring opening 1121 comprises at least two outer ring opening terminals 1122, 1123. In addition, the interlaced structure 1130 comprises a first connection portion 1132 and a second connection portion 1134.

With respect to connection, the first connection portion 1132 is coupled to one of the inner ring opening terminals (for example, the inner ring opening terminal 1116) and one of the outer ring opening terminals (for example, the outer ring opening terminal 1122) in an interlaced manner. In addition, the second connection portion 1134 and the first connection portion 1132 are coupled to each other in an interlaced manner, and the second connection portion 1134 is coupled to the other one of the inner ring opening terminals (for example, the inner ring opening terminal 1115) and the other one of the outer ring opening terminals (for example, the outer ring opening terminal 1123) in an interlaced manner.

Figure 3:
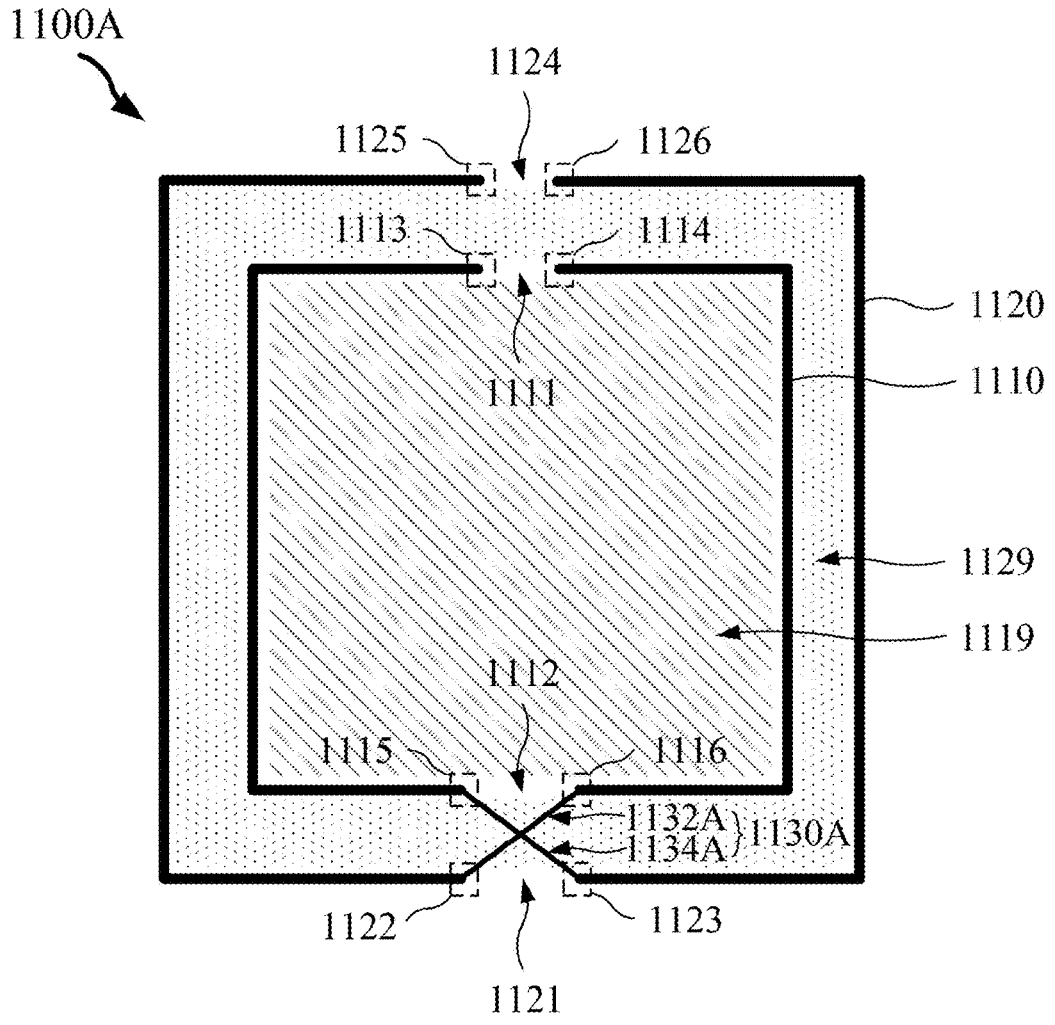
FIG. 3 is a schematic diagram of the guard ring of the integrated inductor structure of FIG. 1A according to embodiments of the present invention.

FIG. 3 is a schematic diagram of the guard ring of the integrated inductor structure of FIG. 1A according to embodiments of the present invention. The difference between the guard ring 1100A of FIG. 3 and the guard ring 1100 in FIG. 2 is that the outer ring 1120 of the guard ring 1100A of FIG. 3 further comprises an additional outer ring opening (for example, the outer ring opening 1124). Specifically, the outer ring 1120 comprises at least two outer ring openings 1121, 1124. With respect to connection, the interlaced structure 1130A is coupled to one of the at least two inner ring openings (for example, the inner ring opening 1112) and one of the at least two outer ring openings (for example, the outer ring opening 1121) in an interlaced manner. However, the present invention is not limited in the structure as shown in FIG. 3, and the interlaced structure 1130A can selectively be coupled to other inner ring openings and outer ring openings in an interlaced manner, for example, the interlaced structure 1130A can be coupled to the inner ring opening 1111 and the outer ring opening 1124 in an interlaced manner.

With continued reference to FIG. 3, the structure of the guard ring 1100A will be described in detail hereinafter. The inner ring opening 1111 comprises at least two inner ring opening terminals 1113, 1114. The inner ring opening 1112 comprises at least two inner ring opening terminals 1115, 1116. The outer ring opening 1121 comprises at least two outer ring opening terminals 1122, 1123. The outer ring opening 1124 comprises at least two outer ring opening terminals 1125, 1126. In addition, the interlaced structure 1130A comprises a first connection portion 1132A and a second connection portion 1134A.

With respect to structure, one of the at least two inner ring openings (for example, the inner ring opening 1112) is disposed at one side of the integrated inductor structure 1000 (for example, the bottom of FIG. 3). In addition, one of the at least two outer ring openings (for example, the outer ring opening 1121) is disposed at the side of the integrated inductor structure 1000 (for example, the bottom of FIG. 3). With respect to connection, the first connection portion 1132A of the interlaced structure 1130A is coupled to one of the inner ring opening terminals (for example, the inner ring opening terminal 1115) and one of the outer ring opening terminals (for example, the outer ring opening terminal 1123). Moreover, the second connection portion 1134A and the first connection portion 1132A are coupled to each other in an interlaced manner, and the second connection portion 1134A is coupled to the other one of the inner ring opening terminals (for example, the inner ring opening terminal 1116) and the other one of the outer ring opening terminals (for example, the outer ring opening terminal 1122) in an interlaced manner.

In one embodiment, with reference to both FIG. 2 and FIG. 3, an area inside the inner ring 1110 is a first area 1119. In addition, an area extending from outside of the inner ring 1110 to the outer ring 1120 is a second area 1129. The patterned ground shield 1200 can be disposed in the first area 1119 or the second area 1129 depending on actual requirements. Moreover, the patterned ground shield 1200 can be disposed in both of the first area 1119 and the second area 1129 depending on actual requirements.

Figure 4:
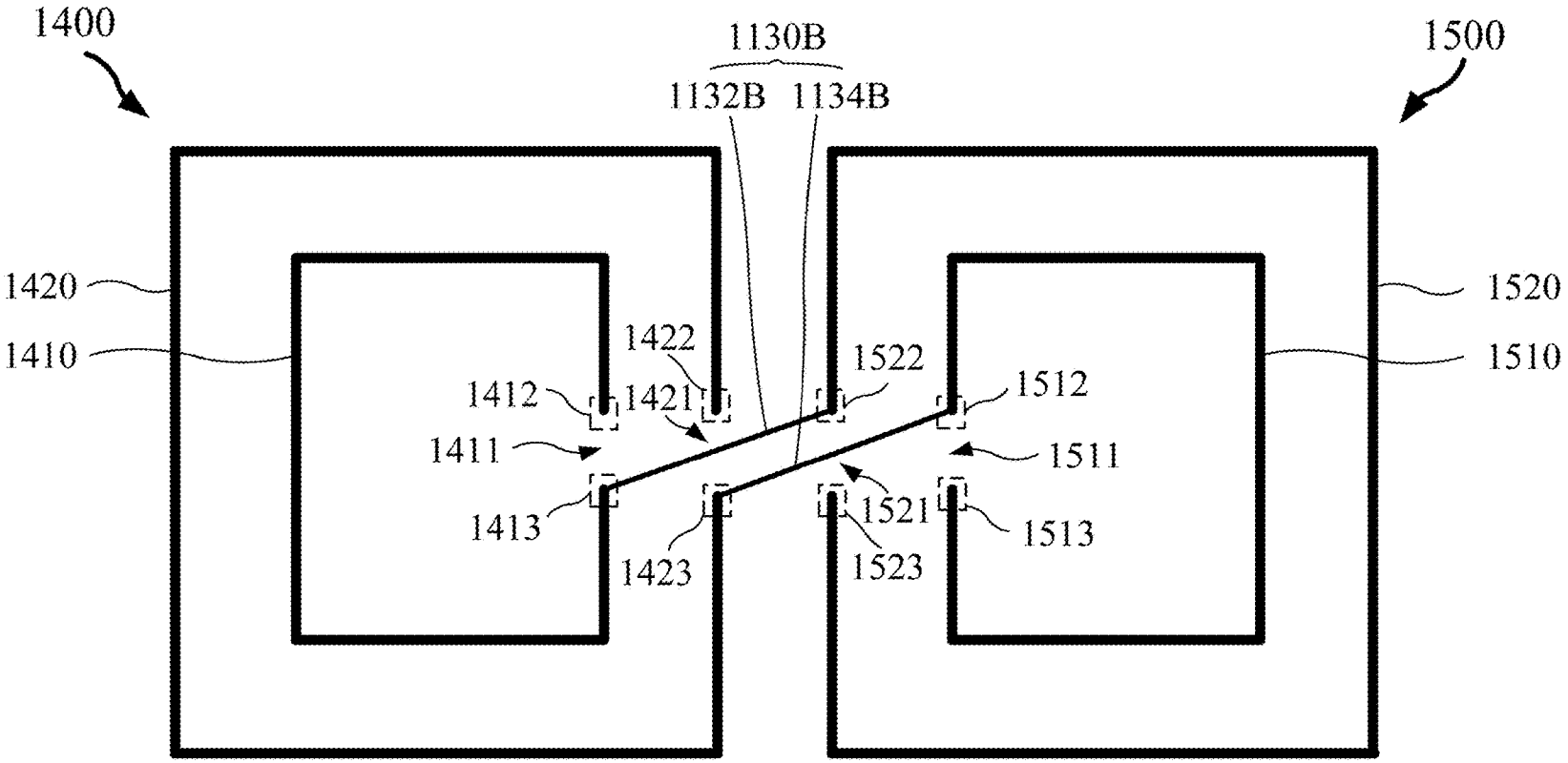
FIG. 4 is a schematic diagram of the guard ring of the integrated inductor structure of FIG. 1A according to embodiments of the present invention.

FIG. 4 is a schematic diagram of the guard ring of the integrated inductor structure of FIG. 1A according to embodiments of the present invention. The integrated inductor structure 1000 may comprise two guard rings depending on actual requirements. For example, the integrated inductor structure 1000 may comprise a first guard ring 1400 and a second guard ring 1500 as shown in FIG. 4. The first guard ring 1400 comprises a first inner ring 1410 and a first outer ring 1420. The first inner ring 1410 comprises at least one first inner ring opening 1411, and the first outer ring 1420 comprises at least one first outer ring opening 1421. In addition, the second guard ring 1500 comprises a second inner ring 1510 and a second outer ring 1520. The second inner ring 1510 comprises at least one second inner ring opening 1511, and the second outer ring 1520 comprises at least one second outer ring opening 1521.

With respect to structure, the interlaced structure 1130B of the integrated inductor structure 1000 is coupled to the first inner ring opening 1411 and the second outer ring opening 1521 in an interlaced manner. The interlaced structure 1130B is also coupled to the first outer ring opening 1421 and the second inner ring opening 1511 in an interlaced manner. In addition, the patterned ground shield 1200 is disposed at inner sides of the first inner ring 1410 and the second inner ring 1510, and the inductor 1300 is formed above the guard rings 1400, 1500 and the patterned ground shield 1200.

With continued reference to FIG. 4, the structure of the guard rings 1400, 1500 will be described in detail hereinafter. The first inner ring opening 1411 comprises a first inner ring opening terminal 1412 and a second inner ring opening terminal 1413. The first inner ring opening terminal 1412 is disposed at a first side (for example, the upper side of FIG. 4), and the second inner ring opening terminal 1413 is disposed at a second side (for example, the lower side of FIG. 4). In addition, the first outer ring opening 1421 comprises a first outer ring opening terminal 1422 and a second outer ring opening terminal 1423. The first outer ring opening terminal 1422 is disposed at the first side, and the second outer ring opening terminal 1423 is disposed at the second side.

In addition, the second inner ring opening 1511 comprises a third inner ring opening terminal 1512 and a fourth inner ring opening terminal 1513. The third inner ring opening terminal 1512 is disposed at the first side, and the fourth inner ring opening terminal 1513 is disposed at the second side. In addition, the second outer ring opening 1521 comprises a third outer ring opening terminal 1522 and a fourth outer ring opening terminal 1523. The third outer ring opening terminal 1522 is disposed at the first side, and the fourth outer ring opening terminal 1523 is disposed at the second side. Moreover, the interlaced structure 1130B comprises a first connection portion 1132B and a second connection portion 1134B. With respect to connection, the first connection portion 1132B is coupled to the second inner ring opening terminal 1413 and the third outer ring opening terminal 1522, and the second connection portion 1134B is coupled to the second outer ring opening terminal 1423 and the third inner ring opening terminal 1512. However, the present invention is not limited to the structure as shown in FIG. 4, and the structure as shown in FIG. 4 is only for illustration purposes.

Figure 5:
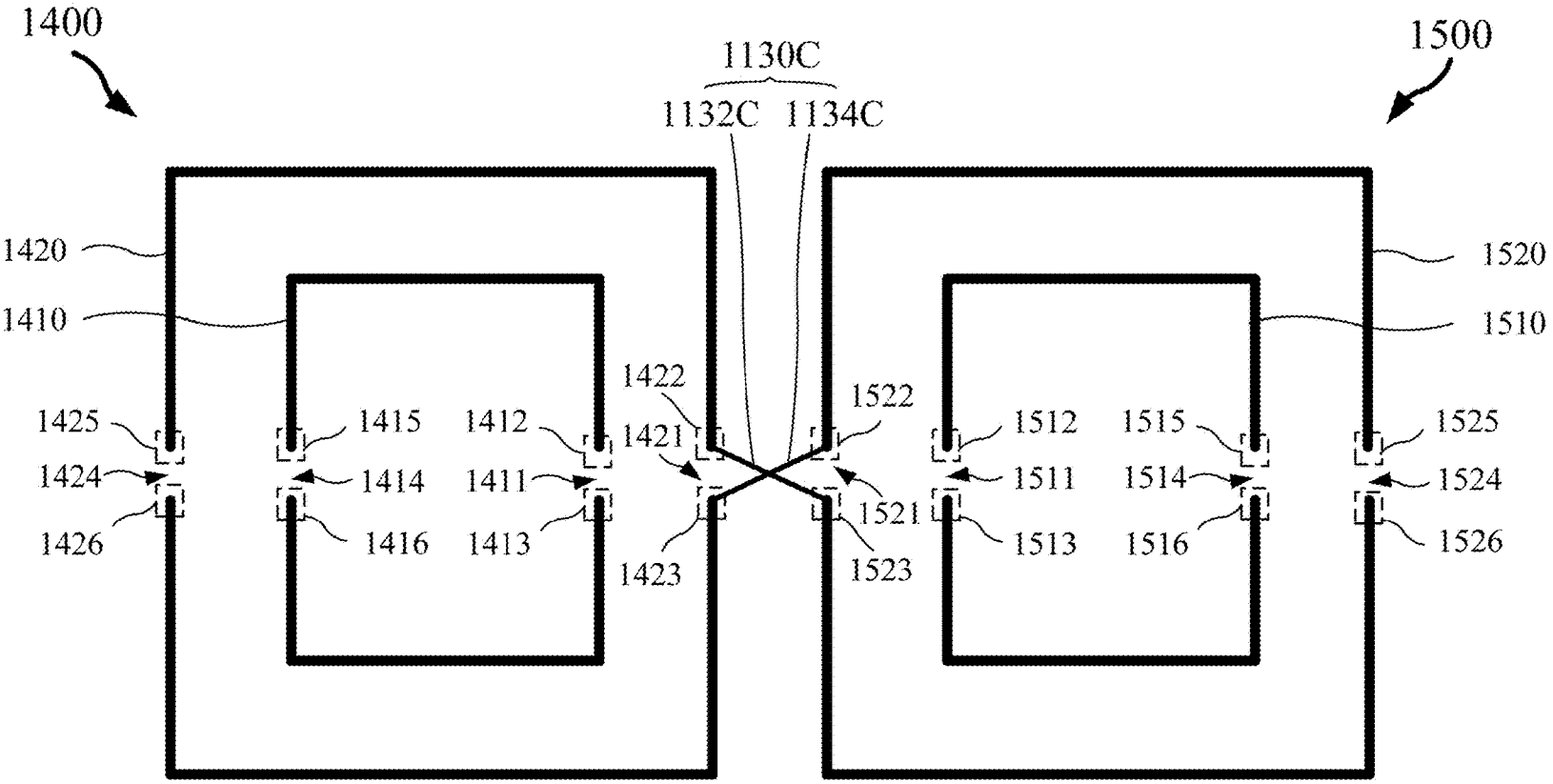
FIG. 5 is a schematic diagram of the guard ring of the integrated inductor structure of FIG. 1A according to embodiments of the present invention.

FIG. 5 is a schematic diagram of the guard ring of the integrated inductor structure of FIG. 1A according to embodiments of the present invention. The difference between the guard ring of FIG. 5 and the guard ring of FIG. 4 is that the inner ring and the outer ring of the guard rings 1400, 1500 in FIG. 5 further comprise another opening, and the connection of the interlaced structure 1130C is different, which will be described in detail below. The first inner ring 1410 of the first guard ring 1400 in FIG. 5 comprises at least two first inner ring openings 1411, 1414, the first outer ring 1420 comprises at least two first outer ring openings 1421, 1424, the second inner ring 1510 comprises at least two second inner ring openings 1511, 1514, and the second outer ring 1520 comprises at least two second outer ring openings 1521, 1524.

With continued reference to FIG. 5, with respect to connection, the first connection portion 1132C of the interlaced structure 1130C is coupled to the first outer ring opening terminal 1422 and the fourth outer ring opening terminal 1523, and the second connection portion 1134C is coupled to the second outer ring opening terminal 1423 and the third outer ring opening terminal 1522. However, the present invention is not limited to the structure as shown in FIG. 5, and the structure as shown in FIG. 5 is only for illustration purposes.

Figure 6:
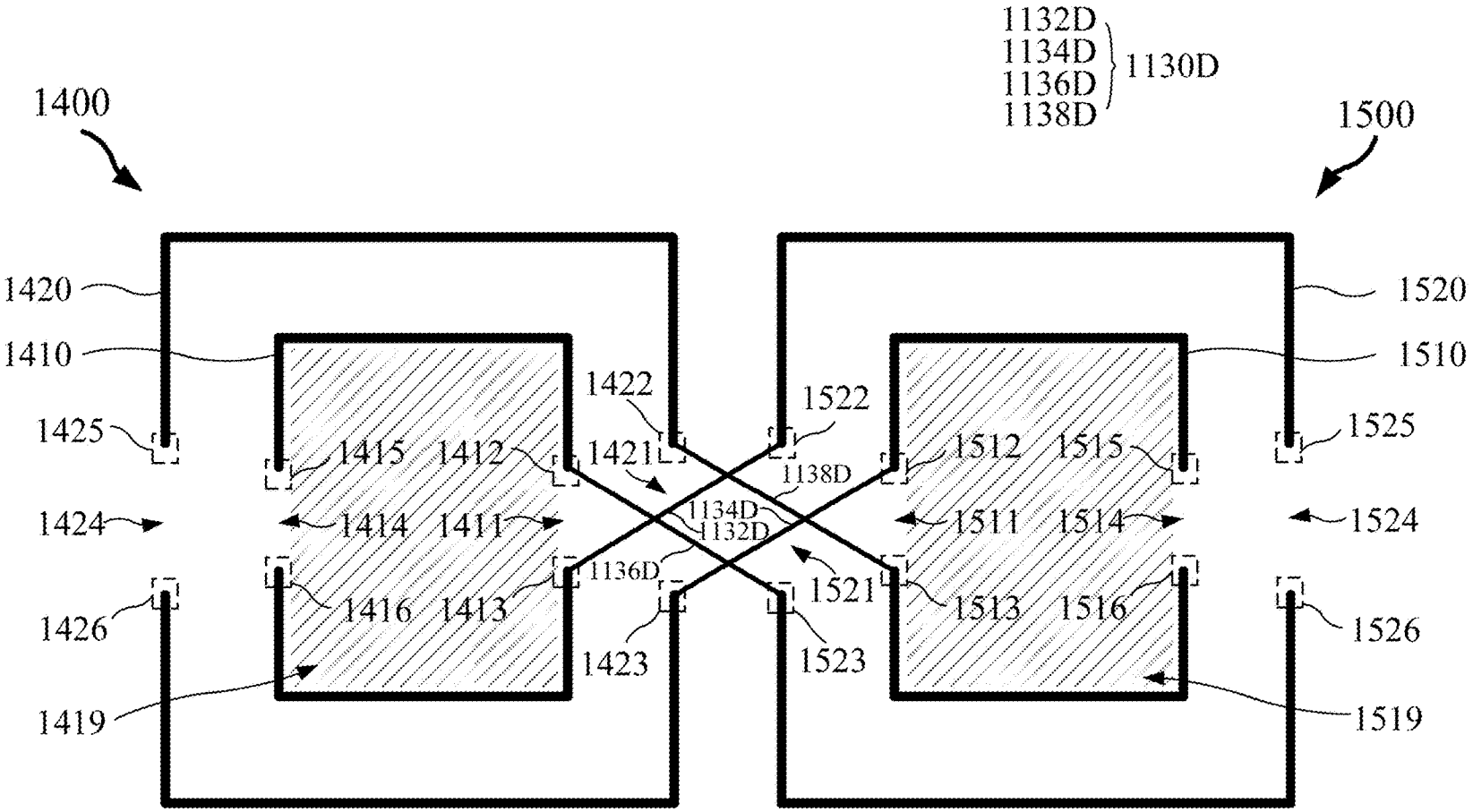
FIG. 6 is a schematic diagram of the guard ring of the integrated inductor structure of FIG. 1A according to embodiments of the present invention.

FIG. 6 is a schematic diagram of the guard ring of the integrated inductor structure of FIG. 1A according to embodiments of the present invention. The difference between the guard ring of FIG. 6 and the guard ring of FIG. 5 is that the interlaced structures are different from each other, which will be described in detail below. The interlaced structure 1130D in FIG. 6 comprises a first connection portion 1132D, a second connection portion 1134D, a third connection portion 1136D, and a fourth connection portion 1138D. With respect to connection, the first connection portion 1132D is coupled to the second inner ring opening terminal 1413 and the third outer ring opening terminal 1522. The second connection portion 1134D is coupled to the second outer ring opening terminal 1423 and the third inner ring opening terminal 1512. The third connection portion 1136D is coupled to the first connection portion 1132D and the second connection portion 1134D in an interlaced manner, and the third connection portion 1136D is coupled to the first inner ring opening terminal 1412 and the fourth outer ring opening terminal 1523. The fourth connection portion 1138D is coupled to the first connection portion 1132D and the second connection portion 1134D in an interlaced manner, and the fourth connection portion 1138D is coupled to the first outer ring opening terminal 1422 and the fourth inner ring opening terminal 1513. However, the present invention is not limited to the structure as shown in FIG. 6, and the structure as shown in FIG. 6 is only for illustration purposes.

Figure 7:
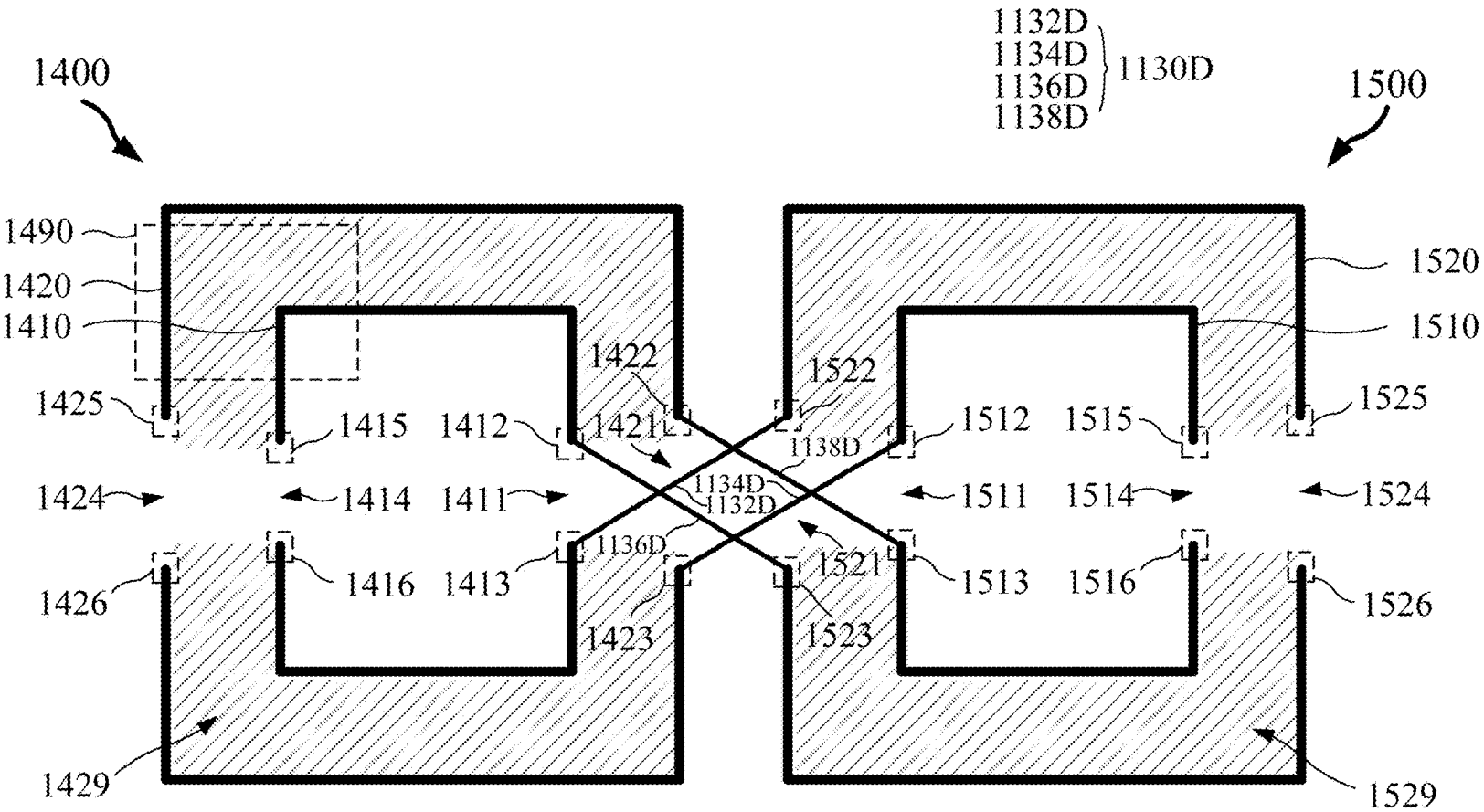
FIG. 7 is a schematic diagram of the guard ring of the integrated inductor structure of FIG. 1A according to embodiments of the present invention.

FIG. 7 is a schematic diagram of the guard ring of the integrated inductor structure of FIG. 1A according to embodiments of the present invention. The difference between the guard ring of FIG. 7 and the guard ring of FIG. 6 is that the disposition locations of the inductor 1300 are different, which will be described in detail below. Referring to FIG. 6, areas inside the first inner ring 1410 and the second inner ring 1510 are first areas 1419, 1519, and the inductor 1300 can be disposed in the first areas 1419, 1519. Referring to FIG. 7, an area extending from outside of the first inner ring 1410 to the first outer ring 1420 and an area extending from outside of the second inner ring 1510 to the second outer ring 1520 are second areas 1429, 1529, and the inductor 1300 can be disposed in the second areas 1429, 1529 depending on actual requirements. In another embodiment, the inductor 1300 can be disposed in both of the first areas 1419, 1519 and the second areas 1429, 1529 depending on actual requirements. However, the present invention is not limited to the structure as shown in FIG. 7, and the structure as shown in FIG. 7 is only for illustration purposes.

In another embodiment, in addition to disposing the inner ring opening 1414 and the outer ring opening 1424 of the first guard ring 1400 of the integrated inductor structure 1000 in FIG. 5-FIG. 7 at the left side of the first guard ring 1400 (the upper, lower, left, and right sides as they appear in the drawings are used as reference directions, and this will continue to be the case hereinafter), the inner ring opening 1414 and the outer ring opening 1424 can be disposed at the upper side or the lower side of the first guard ring 1400 depending on actual requirements. Similarly, in addition to disposing the inner ring opening 1514 and the outer ring opening 1524 of the second guard ring 1500 of the integrated inductor structure 1000 as shown in FIG. 5-FIG. 7 at the right side of the second guard ring 1500, the inner ring opening 1514 and the outer ring opening 1524 can be disposed at the upper side or the lower side of the second guard ring 1500 depending on actual requirements.

Figure 8:
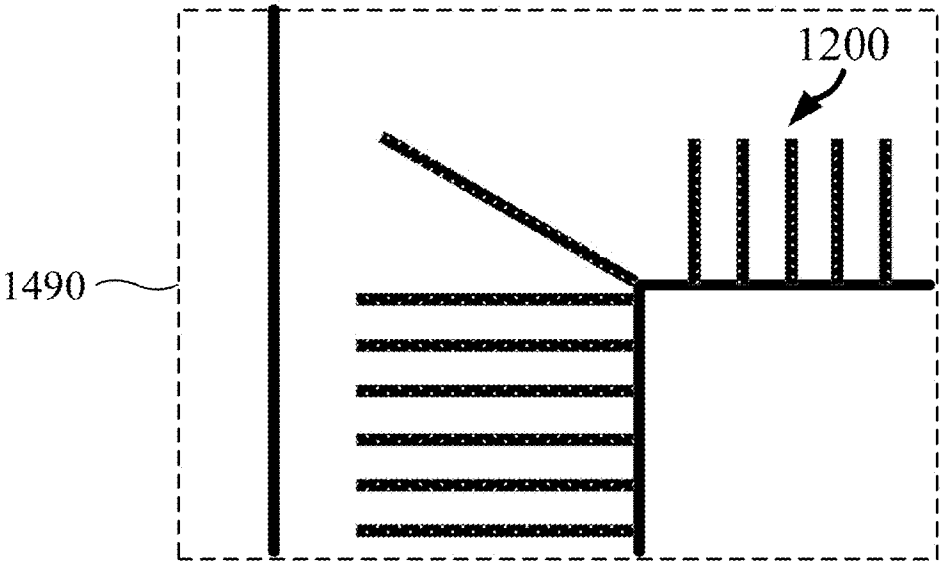
FIG. 8 is a partial schematic diagram of the integrated inductor structure of FIG. 7 according to embodiments of the present invention.

FIG. 8 is a partial schematic diagram of the integrated inductor structure of FIG. 7 according to embodiments of the present invention. As shown in FIG. 8, a structure of a section 1490 of the second area 1429 in FIG. 7 is further illustrated. The inductor 1300 is disposed in the section 1490 of the second area 1429 depending on actual requirements. The patterned ground shield 1200 can be disposed under the inductor 1300, and the disposition thereof is illustrated as the structure of the section 1490 of the second area 1429 in FIG. 8.

Figure 9:
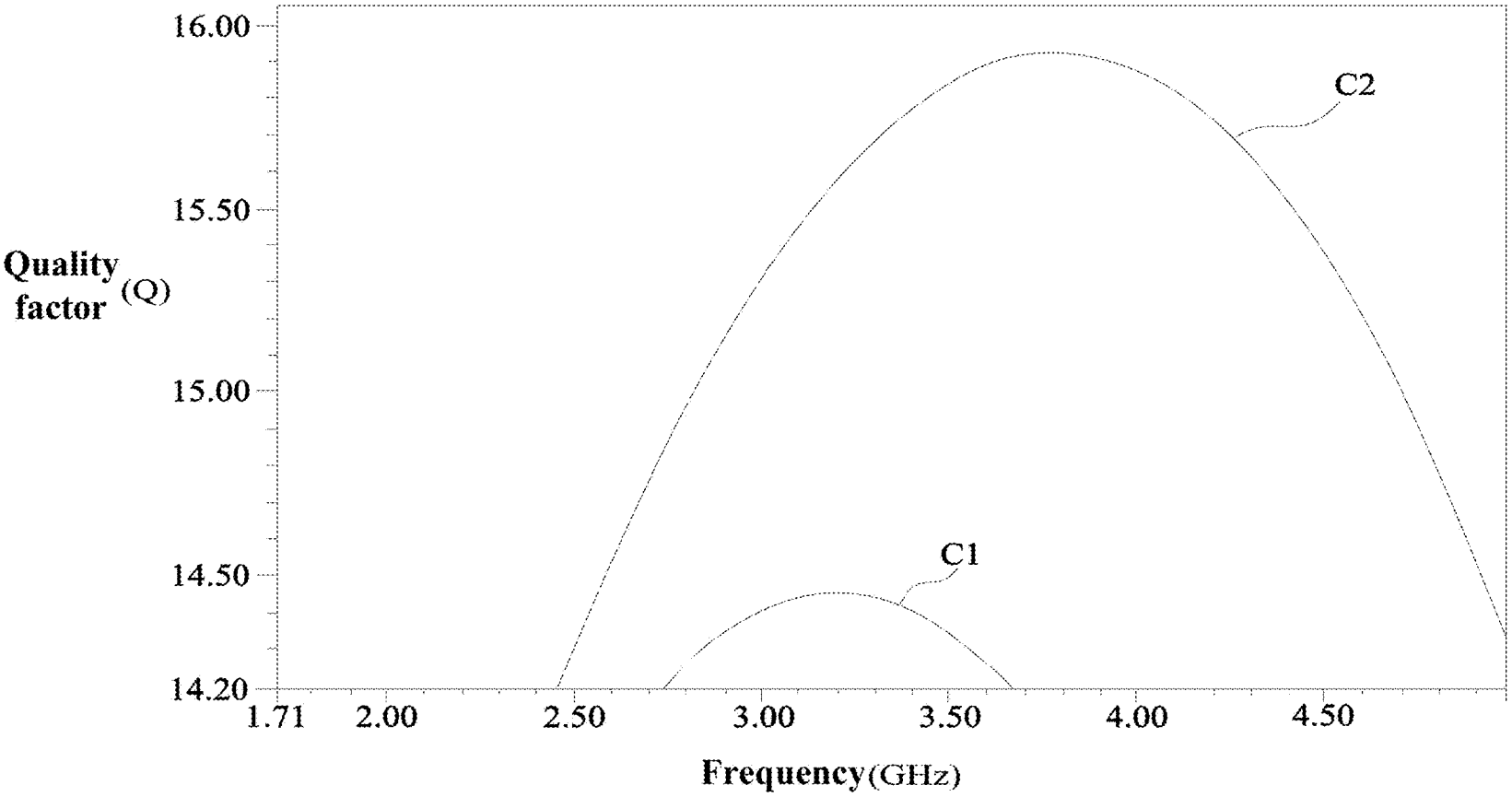
FIG. 9 is a graph showing experimental data of an integrated inductor structure according to embodiments of the present invention.

FIG. 9 is a graph showing experimental data of an integrated inductor structure according to embodiments of the present invention. This experimental data diagram is used for describing the quality factor of the inductor 1300 of the integrated inductor structure 1000 when the inductor 1300 operates in different frequencies. As shown in FIG. 9, the curve C1 represents experimental data if the improvement structures of the guard ring 1100 and the patterned ground shield 1200 provided by the present invention are not employed. The curve C2 represents experimental data if the improvement structures of the guard ring 1100 and the patterned ground shield 1200 provided by the present invention are employed. As can be seen in FIG. 9, the integrated inductor structure 1000 employing the improvement structures of the guard ring 1100 and the patterned ground shield 1200 indeed results in an improvement of the quality factor of the inductor 1300 of the integrated inductor structure 1000. Therefore, the experimental data proves that the integrated inductor structure 1000 of the present invention indeed improves the quality factor of the inductor 1300.

Figure 10:
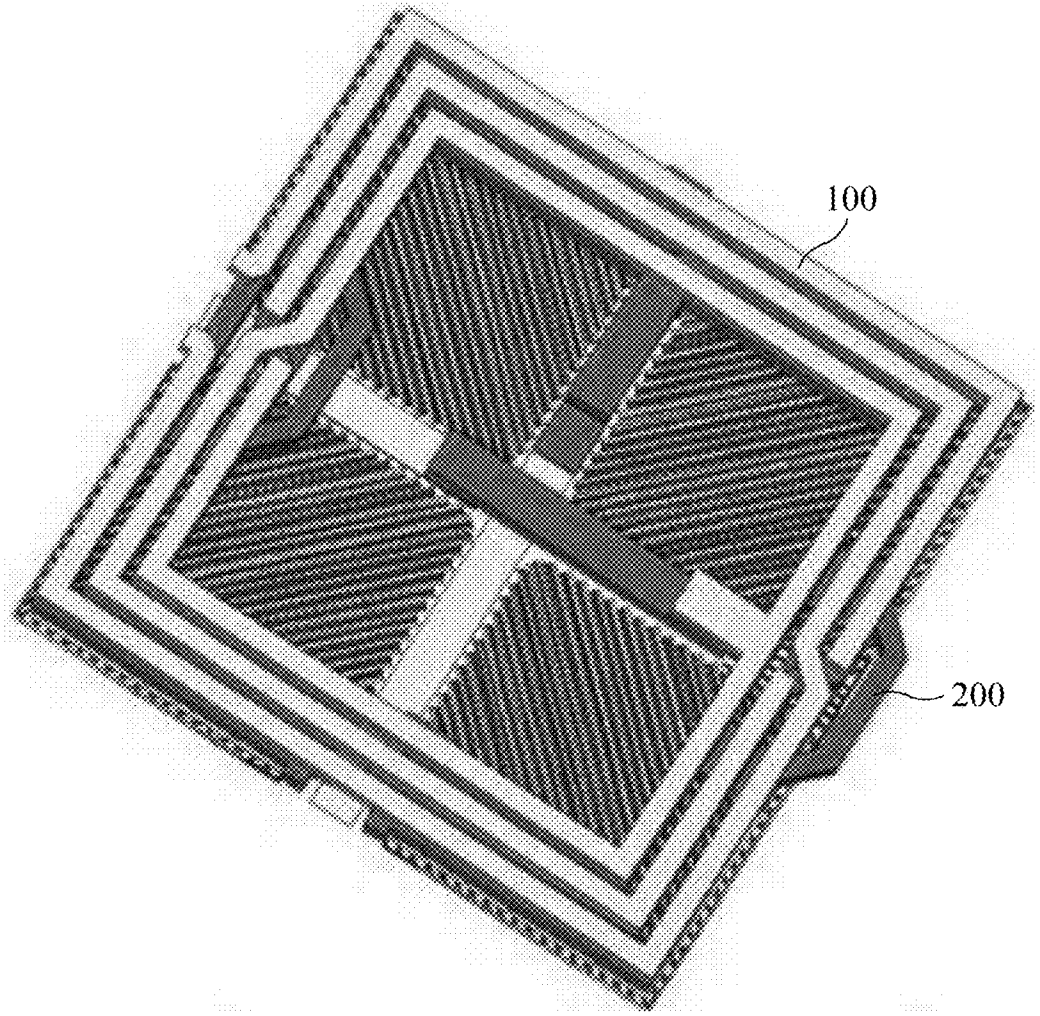
FIG. 10 is a schematic diagram of an integrated inductor structure according to embodiments of the present invention.
Figure 11:
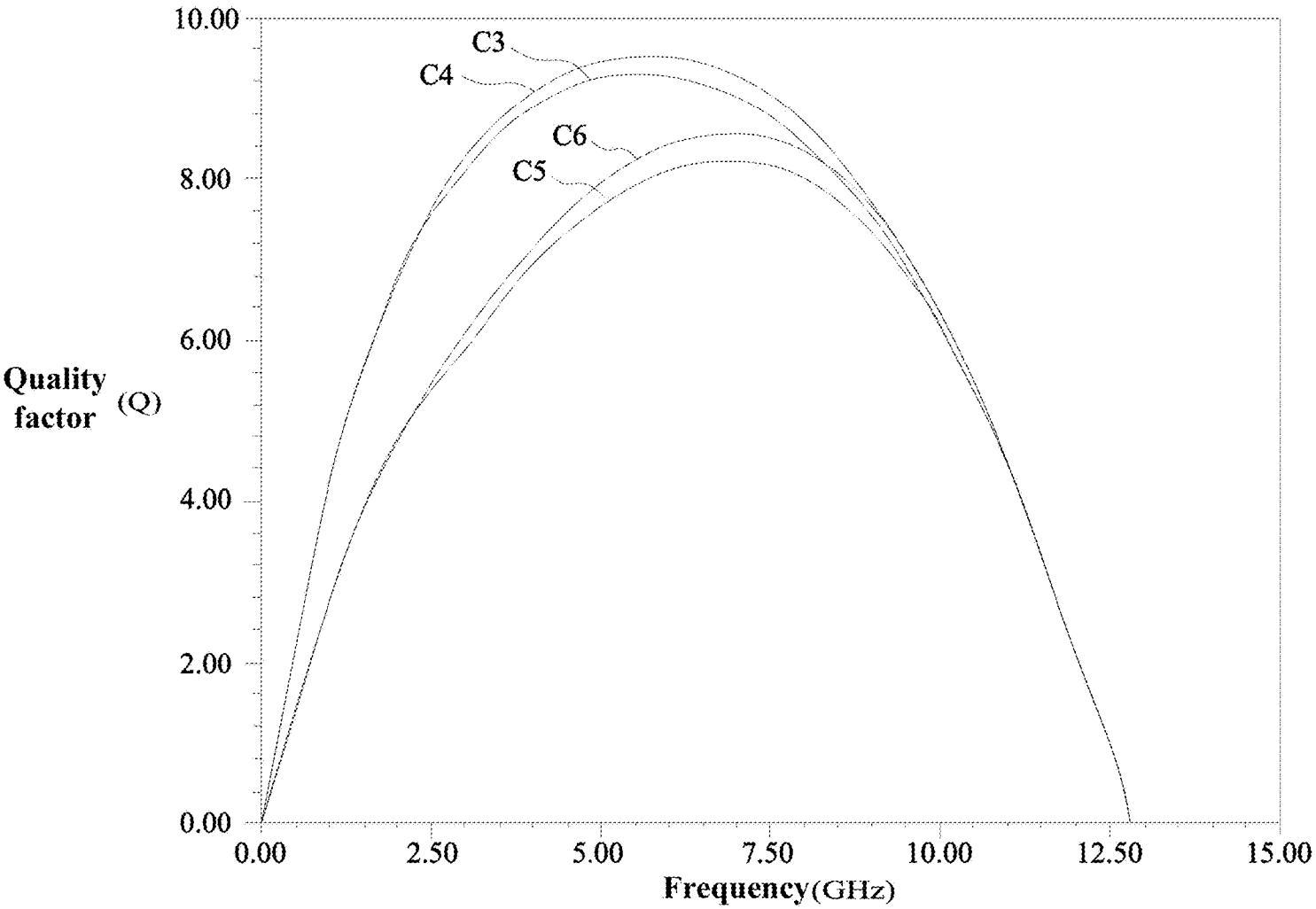
FIG. 11 is a graph showing experimental data of an integrated inductor structure according to embodiments of the present invention.

FIG. 10 is a schematic diagram of an integrated inductor structure according to embodiments of the present invention. The transformer described herein is a vertically stacked three-ring type transformer. The size is about 120 μm×120 μm, the width of the wire is about 4 μm, the wire spacing is about 3 μm, and the inner diameter is about 50 μm. When comparing a conventional shield design with a single guard ring to the shield design of the present invention with the improvement guard ring, the quality factor of the inductor of the present invention can be enhanced by 5%. The enhancement of the quality factor of the inductor can be proven by experimental data shown in FIG. 11. In FIG. 11, the curve C3 represents experimental data if the inductor 100 as shown in FIG. 10 employs the conventional shield design with a single guard ring. The curve C4 represents experimental data if the inductor 100 as shown in FIG. 10 employs the shield design of the present invention with the improved guard ring. As shown in FIG. 11, the shield design of the present invention with the improved guard ring may enhance the quality factor by about 5%. In addition, the curve C5 represents experimental data if the inductor 200 as shown in FIG. 10 employs the conventional shield design with a single guard ring. The curve C6 represents experimental data if the inductor 200 as shown in FIG. 10 employs the shield design of the present invention with the improved guard ring. As shown in FIG. 11, the shield design of the present invention with the improved guard ring may enhance the quality factor by about 5%.

In view of the above embodiments of the present disclosure, it is apparent that the application of the present invention has a number of advantages. Embodiments of the present disclosure provide an integrated inductor structure with an improved guard ring and patterned ground shield. The embodiments of the present disclosure can result in improvements in the quality factor of the inductor of the integrated inductor and enhance the efficiency of the integrated inductor structure. In addition, the improvement structure of the guard ring employed in the integrated inductor structure can block steam out of the guard ring, such that the steam will not affect other structures inside the guard ring.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An integrated inductor structure, comprising:

a first guard ring comprising:

a first inner ring disposed in a first metal layer and comprising at least one first inner ring opening; and a first outer ring disposed in a second metal layer and comprising at least one first outer ring opening;

a second guard ring comprising:

a second inner ring disposed in the first metal layer and comprising at least one second inner ring opening;

a second outer ring disposed in the second metal layer and comprising at least one second outer ring opening;

an interlaced structure comprising:

a first plurality of connection portions arranged and directly connected between end terminals of the at least one first inner ring opening and end terminals of the at least one second outer ring opening in an interlaced manner, in order to couple the at least one first inner ring to the at least one second outer ring; and a second plurality of connection portions arranged and directly connected between end terminals of the at least one first outer ring opening and end terminals of the at least one second inner ring opening in an interlaced manner, in order to couple the at least one first outer ring to the at least one second inner ring;

a patterned ground shield disposed at inner sides of the first inner ring and the second inner ring, and coupled to the first inner ring, the first outer ring, the second inner ring, and the second outer ring; and an inductor formed above the guard ring and the patterned ground shield.

2. The integrated inductor structure of claim 1, wherein the first inner ring opening comprises:

a first inner ring opening terminal disposed at a first side; and a second inner ring opening terminal disposed at a second side;

wherein the first outer ring opening comprises:

a first outer ring opening terminal disposed at the first side; and a second outer ring opening terminal disposed at the second side;

wherein the second inner ring opening comprises:

a third inner ring opening terminal disposed at the first side; and a fourth inner ring opening terminal disposed at the second side;

wherein the second outer ring opening comprises:

a third outer ring opening terminal disposed at the first side; and a fourth outer ring opening terminal disposed at the second side;

wherein the first plurality of connection portions of the interlaced structure comprises:

a first connection portion directly coupled to the second inner ring opening terminal and the third outer ring opening terminal;

wherein the second plurality of connection portions of the interlaced structure comprises:

a second connection portion directly coupled to the second outer ring opening terminal and the third inner ring opening terminal.

3. The integrated inductor structure of claim 1, wherein the first inner ring comprises at least two first inner ring openings, the first outer ring comprises at least two first outer ring openings, the second inner ring comprises at least two second inner ring openings, the second outer ring comprises at least two second outer ring openings, wherein the first plurality of connection portions of the interlaced structure are coupled to one of the at least two first inner ring openings and one of the at least two second outer ring openings in an interlaced manner, and the second plurality of connection portions of the interlaced structure are coupled to one of the at least two second inner ring openings and one of the first outer ring openings in an interlaced manner.

4. The integrated inductor structure of claim 3, wherein the first inner ring opening comprises:

a first inner ring opening terminal disposed at a first side; and a second inner ring opening terminal disposed at a second side;

wherein the first outer ring opening comprises:

a first outer ring opening terminal disposed at the first side; and a second outer ring opening terminal disposed at the second side;

wherein the second inner ring opening comprises:

a third inner ring opening terminal disposed at the first side; and a fourth inner ring opening terminal disposed at the second side;

wherein the second outer ring opening comprises:

a third outer ring opening terminal disposed at the first side; and a fourth outer ring opening terminal disposed at the second side;

wherein the first plurality of connection portions of the interlaced structure comprises:

a first connection portion directly coupled to the second inner ring opening terminal and the third outer ring opening terminal; and a second connection portion directly coupled to the first inner ring opening terminal and the fourth outer ring opening terminal;

wherein the second plurality of connection portions of the interlaced structure comprises;

a third connection portion directly coupled to the second outer ring opening terminal and the third inner ring opening terminal; and a fourth connection portion directly coupled to the first outer ring opening terminal and the fourth inner ring opening terminal.

5. The integrated inductor structure of claim 1, wherein an area inside the first inner ring and the second inner ring is a first area, wherein an area extending from outside of the first inner ring to the first outer ring and extending from outside of the second inner ring to the second outer ring is a second area, wherein the inductor is disposed in any one of the first area and the second area, or the inductor is disposed in the first area and the second area, wherein the patterned ground shield is disposed in any one of the first area and the second area, or the patterned ground shield is disposed in the first area and the second area.

6. The integrated inductor structure of claim 2, wherein an area inside the first inner ring and the second inner ring is a first area, wherein an area extending from outside of the first inner ring to the first outer ring and extending from outside of the second inner ring to the second outer ring is a second area, wherein the inductor is disposed in any one of the first area and the second area, or the inductor is disposed in the first area and the second area, wherein the patterned ground shield is disposed in any one of the first area and the second area, or the patterned ground shield is disposed in the first area and the second area.

7. The integrated inductor structure of claim 3, wherein an area inside the first inner ring and the second inner ring is a first area, wherein an area extending from outside of the first inner ring to the first outer ring and extending from outside of the second inner ring to the second outer ring is a second area, wherein the inductor is disposed in any one of the first area and the second area, or the inductor is disposed in the first area and the second area, wherein the patterned ground shield is disposed in any one of the first area and the second area, or the patterned ground shield is disposed in the first area and the second area.

8. The integrated inductor structure of claim 4, wherein an area inside the first inner ring and the second inner ring is a first area, wherein an area extending from outside of the first inner ring to the first outer ring and extending from outside of the second inner ring to the second outer ring is a second area, wherein the inductor is disposed in any one of the first area and the second area, or the inductor is disposed in the first area and the second area, wherein the patterned ground shield is disposed in any one of the first area and the second area, or the patterned ground shield is disposed in the first area and the second area.

* * * * *